US007862456B2

(12) United States Patent
Halko et al.

(10) Patent No.: US 7,862,456 B2
(45) Date of Patent: Jan. 4, 2011

(54) HOCKEY STICK

(75) Inventors: Roman D. Halko, Chula Vista, CA (US); Homayun Ghassemi, San Diego, CA (US); Edward M. Goldsmith, Studio City, CA (US)

(73) Assignee: Easton Sports, Inc., Van Nuys, CA (US)

( * ) Notice: Subject to any disclaimer, the term of this patent is extended or adjusted under 35 U.S.C. 154(b) by 0 days.

(21) Appl. No.: 11/820,462

(22) Filed: Jun. 18, 2007

(65) Prior Publication Data

US 2007/0249437 A1 Oct. 25, 2007

Related U.S. Application Data

(60) Division of application No. 10/689,545, filed on Oct. 20, 2003, now Pat. No. 7,232,386, which is a continuation-in-part of application No. 10/439,652, filed on May 15, 2003.

(51) Int. Cl.
*A63B 59/14* (2006.01)

(52) U.S. Cl. ..... 473/561; 473/563

(58) Field of Classification Search ..... 473/560–563
See application file for complete search history.

(56) References Cited

U.S. PATENT DOCUMENTS

| | | | |
|---|---|---|---|
| 1,601,116 | A | 9/1926 | Hall |
| 2,201,706 | A | 5/1940 | Sukohl |
| 2,304,322 | A | 12/1942 | Werlich |
| 2,649,133 | A | 8/1953 | Just |
| 2,674,557 | A | 4/1954 | Boggs |
| 2,762,739 | A | 9/1956 | Weiss |
| 2,774,596 | A | 12/1956 | Bredenberg |
| 2,912,245 | A | 11/1959 | Gardner et al. |
| 2,964,065 | A | 12/1960 | Haroldson |
| 3,020,192 | A | 2/1962 | Stephens et al. |
| 3,125,478 | A | 3/1964 | Pratt |
| 3,353,826 | A | 11/1967 | Traverse |
| 3,489,412 | A | 1/1970 | Franck et al. |
| 3,533,623 | A | 10/1970 | Dumont |
| 3,544,104 | A | 12/1970 | Jenks |
| 3,561,760 | A | 2/1971 | Klay |
| 3,563,546 | A | 2/1971 | Dawe |
| 3,606,326 | A | 9/1971 | Sparks et al. |
| 3,631,897 | A | 1/1972 | Fischer et al. |
| 3,638,942 | A | 2/1972 | Bassett |
| 3,727,936 | A | 4/1973 | Klir et al. |
| 3,809,401 | A | 5/1974 | Hankele |

(Continued)

FOREIGN PATENT DOCUMENTS

| | | |
|---|---|---|
| CA | 489072 | 12/1952 |

(Continued)

*Primary Examiner*—Mark S Graham
(74) *Attorney, Agent, or Firm*—Orrick, Herrington, Sutcliffe LLP

(57) ABSTRACT

A composite hockey stick having a tubular hollow rectangular shaft and a blade is disclosed. The shaft comprises an inner layer and an outer layer, each of the inner and outer layers are formed of uni-directional substantially continuous fibers disposed in a hardened resin matrix and wrapped and molded around a middle elastomer layer. A new manufacturing method is also disclosed in which a cured hollow tubular composite hockey stick shaft is inserted between the front and back faces of an un-cured composite hockey stick blade and the blade is then cured in a mold around the hockey stick shaft to form a unitary composite hockey stick.

18 Claims, 9 Drawing Sheets

U.S. PATENT DOCUMENTS

| | | | |
|---|---|---|---|
| 3,813,098 | A | 5/1974 | Fischer et al. |
| 3,851,880 | A | 12/1974 | Ritch |
| 3,859,162 | A | 1/1975 | Johnson et al. |
| 3,910,578 | A | 10/1975 | Brine, Jr. |
| 3,934,875 | A | 1/1976 | Easton et al. |
| 3,961,790 | A | 6/1976 | Milligan |
| 3,970,324 | A | 7/1976 | Howat |
| 3,982,760 | A | 9/1976 | Titola |
| 4,013,288 | A | 3/1977 | Goverde |
| 4,013,810 | A | 3/1977 | Long |
| 4,016,640 | A | 4/1977 | Briggs |
| D244,790 | S | 6/1977 | Carlson et al. |
| 4,052,499 | A | 10/1977 | Goupil et al. |
| 4,059,269 | A | 11/1977 | Titola |
| 4,061,520 | A | 12/1977 | Cecka et al. |
| 4,070,020 | A | 1/1978 | Dano |
| 4,070,021 | A | 1/1978 | Cecka et al. |
| 4,076,240 | A | 2/1978 | Haddad |
| 4,084,818 | A | 4/1978 | Goupil et al. |
| 4,086,115 | A | 4/1978 | Sweet, Jr. et al. |
| 4,124,208 | A | 11/1978 | Burns |
| 4,124,670 | A | 11/1978 | Cecka et al. |
| 4,128,963 | A | 12/1978 | Dano |
| 4,129,634 | A | 12/1978 | Cecka et al. |
| 4,134,198 | A | 1/1979 | Briggs |
| 4,134,587 | A | 1/1979 | Diederich |
| 4,148,482 | A | 4/1979 | Harwell, Jr. et al. |
| 4,159,114 | A | 6/1979 | Ardell et al. |
| 4,172,594 | A | 10/1979 | Diederich |
| 4,180,413 | A | 12/1979 | Diederich |
| 4,200,479 | A | 4/1980 | Ardell et al. |
| 4,212,461 | A | 7/1980 | Cecka et al. |
| 4,239,215 | A | 12/1980 | Farr |
| 4,241,115 | A | 12/1980 | Temin |
| 4,273,601 | A | 6/1981 | Weingart |
| 4,320,160 | A | 3/1982 | Nishimura et al. |
| 4,343,468 | A | 8/1982 | Lindgren |
| 4,351,528 | A | 9/1982 | Duplin |
| 4,353,549 | A | 10/1982 | Goupil et al. |
| 4,358,113 | A | 11/1982 | McKinnon et al. |
| 4,358,117 | A | 11/1982 | Deutsch |
| 4,361,325 | A | 11/1982 | Jansen |
| 4,369,970 | A | 1/1983 | Salminen |
| 4,461,479 | A | 7/1984 | Mitchell |
| 4,488,721 | A | 12/1984 | Franck et al. |
| 4,504,344 | A | 3/1985 | Helle et al. |
| 4,512,573 | A | 4/1985 | Coolen |
| 4,520,042 | A | 5/1985 | Smith |
| 4,537,398 | A | 8/1985 | Salminen |
| 4,570,932 | A | 2/1986 | Cote |
| 4,579,617 | A | 4/1986 | Öberg et al. |
| 4,591,155 | A | 5/1986 | Adachi |
| 4,600,192 | A | 7/1986 | Adachi |
| 4,651,990 | A | 3/1987 | Profit |
| 4,660,832 | A | 4/1987 | Shomo |
| 4,664,379 | A | 5/1987 | Melby |
| 4,684,130 | A | 8/1987 | Drolet et al. |
| 4,739,994 | A | 4/1988 | Lewis, Jr. |
| 4,765,856 | A | 8/1988 | Doubt |
| 4,770,915 | A | 9/1988 | Nakagawa et al. |
| 4,793,616 | A | 12/1988 | Fernandez |
| 4,799,985 | A | 1/1989 | McMahon et al. |
| 4,818,318 | A | 4/1989 | McMahon et al. |
| 4,871,491 | A | 10/1989 | McMahon et al. |
| 4,874,563 | A | 10/1989 | McMahon et al. |
| 4,923,541 | A | 5/1990 | Burger |
| 4,968,032 | A | 11/1990 | Redekop |
| 4,979,743 | A | 12/1990 | Sears |
| 5,005,254 | A | 4/1991 | Uffindell |
| 5,024,712 | A | 6/1991 | Lecourt et al. |
| 5,042,804 | A | 8/1991 | Uke et al. |
| 5,042,805 | A | 8/1991 | Nakai |
| 5,048,441 | A | 9/1991 | Quigley |
| 5,050,289 | A | 9/1991 | Uffindell |
| 5,050,878 | A | 9/1991 | Deleris |
| 5,067,726 | A | 11/1991 | Brine, III et al. |
| 5,076,872 | A | 12/1991 | Nakagawa et al. |
| 5,078,396 | A | 1/1992 | Cavallaro et al. |
| 5,127,649 | A | 7/1992 | Cabeonero |
| D329,888 | S | 9/1992 | Christian |
| 5,160,135 | A | 11/1992 | Hasegawa |
| 5,174,567 | A | 12/1992 | Nordstrom |
| 5,183,264 | A | 2/1993 | Lanctot |
| 5,188,872 | A | 2/1993 | Quigley |
| 5,206,085 | A | 4/1993 | Nakagawa et al. |
| 5,217,221 | A | 6/1993 | Baum |
| 5,242,637 | A | 9/1993 | Inoue et al. |
| 5,261,662 | A | 11/1993 | Prevost |
| 5,303,916 | A | 4/1994 | Rodgers |
| 5,306,003 | A | 4/1994 | Pagotto |
| 5,312,100 | A | 5/1994 | Ilacqua et al. |
| 5,332,212 | A | 7/1994 | Susi et al. |
| 5,333,857 | A | 8/1994 | Lallemand |
| 5,364,693 | A | 11/1994 | Moren et al. |
| 5,373,616 | A | 12/1994 | Biersdorf et al. |
| 5,380,002 | A | 1/1995 | Spector |
| 5,407,195 | A | 4/1995 | Titola et al. |
| 5,419,553 | A | 5/1995 | Rodgers |
| 5,423,531 | A | 6/1995 | Hoshizaki et al. |
| 5,423,735 | A | 6/1995 | Callinan et al. |
| 5,435,548 | A | 7/1995 | Leduke et al. |
| 5,439,215 | A | 8/1995 | Ratchford |
| 5,456,463 | A | 10/1995 | Dolan et al. |
| 5,458,330 | A | 10/1995 | Baum |
| RE35,081 | E | 11/1995 | Quigley |
| 5,470,067 | A | 11/1995 | Diresta |
| 5,492,425 | A | 2/1996 | Carter et al. |
| 5,496,027 | A | 3/1996 | Christian et al. |
| 5,511,776 | A | 4/1996 | Huru |
| 5,520,385 | A | 5/1996 | Quigley et al. |
| 5,524,884 | A | 6/1996 | Haines |
| 5,533,723 | A | 7/1996 | Baum |
| 5,549,947 | A | 8/1996 | Quigley et al. |
| 5,556,677 | A | 9/1996 | Quigley et al. |
| 5,558,326 | A | 9/1996 | Adamson et al. |
| 5,577,725 | A | 11/1996 | Pagotto et al. |
| 5,582,405 | A | 12/1996 | Montgomery |
| 5,582,406 | A | 12/1996 | Babcock |
| 5,593,158 | A | 1/1997 | Filice |
| 5,599,242 | A | 2/1997 | Solviche et al. |
| 5,603,498 | A | 2/1997 | Crawford et al. |
| 5,605,327 | A | 2/1997 | McCutchen |
| 5,607,154 | A | 3/1997 | Meumann et al. |
| 5,607,226 | A | 3/1997 | Toth et al. |
| 5,624,115 | A | 4/1997 | Baum |
| 5,628,509 | A | 5/1997 | Christian |
| 5,633,299 | A | 5/1997 | Van Druten et al. |
| 5,636,836 | A | 6/1997 | Carroll et al. |
| 5,653,468 | A | 8/1997 | Ostapyk |
| 5,653,643 | A | 8/1997 | Falone et al. |
| 5,655,981 | A | 8/1997 | Reed |
| 5,674,141 | A | 10/1997 | Laforest |
| 5,676,608 | A | 10/1997 | Christian et al. |
| 5,685,791 | A | 11/1997 | Feeney |
| 5,685,792 | A | 11/1997 | Ruoff |
| 5,688,571 | A | 11/1997 | Quigley et al. |
| 5,690,850 | A | 11/1997 | Anderson |
| 5,695,416 | A | 12/1997 | Christian |
| 5,697,857 | A | 12/1997 | Christian et al. |
| 5,700,533 | A | 12/1997 | You |
| 5,718,647 | A | 2/1998 | Tiitola |
| 5,728,008 | A | 3/1998 | Howard |
| 5,728,016 | A | 3/1998 | Hsu |
| 5,744,528 | A | 4/1998 | Callinan et al. |

| | | | |
|---|---|---|---|
| 5,746,955 | A | 5/1998 | Calapp et al. |
| 5,772,541 | A | 6/1998 | Buiatti |
| 5,816,949 | A | 10/1998 | Dutchburn |
| 5,816,962 | A | 10/1998 | Etersque |
| 5,816,963 | A | 10/1998 | Brooks et al. |
| 5,823,901 | A | 10/1998 | Burger |
| 5,827,141 | A | 10/1998 | Lukey et al. |
| 5,839,977 | A | 11/1998 | Maurer et al. |
| D404,449 | S | 1/1999 | Burger |
| 5,863,268 | A | 1/1999 | Birch |
| 5,863,269 | A | 1/1999 | Fillice |
| 5,865,694 | A | 2/1999 | Duong-Van |
| 5,865,696 | A | 2/1999 | Calapp et al. |
| 5,866,051 | A | 2/1999 | Lin et al. |
| 5,879,250 | A | 3/1999 | Tahtinen et al. |
| 5,888,601 | A | 3/1999 | Quigley et al. |
| 5,904,873 | A | 5/1999 | Sadler et al. |
| 5,928,090 | A | 7/1999 | Cabales et al. |
| D412,544 | S | 8/1999 | Burger |
| 5,935,027 | A | 8/1999 | Nashif et al. |
| 5,943,767 | A | 8/1999 | Milam |
| 5,944,617 | A | 8/1999 | Falone et al. |
| 5,967,913 | A | 10/1999 | Sulenta |
| 5,979,288 | A | 11/1999 | Gallagher et al. |
| 5,980,404 | A | 11/1999 | Gentile |
| 5,980,674 | A | 11/1999 | Burger |
| 5,997,970 | A | 12/1999 | You |
| 6,001,035 | A | 12/1999 | Roberts |
| 6,004,900 | A | 12/1999 | O'Brien, III |
| 6,019,691 | A | 2/2000 | Hillborn |
| 6,033,326 | A | 3/2000 | Lee |
| 6,033,327 | A | 3/2000 | Bird |
| 6,033,328 | A | 3/2000 | Bellefleur et al. |
| 6,036,610 | A | 3/2000 | Lewark |
| 6,039,661 | A | 3/2000 | Christian et al. |
| 6,042,485 | A | 3/2000 | Cheng |
| 6,045,906 | A | 4/2000 | McMahon et al. |
| 6,062,995 | A | 5/2000 | Murphy et al. |
| 6,062,996 | A | 5/2000 | Quigley |
| 6,063,839 | A | 5/2000 | Oosedo et al. |
| D430,249 | S | 8/2000 | Burger |
| 6,102,819 | A | 8/2000 | Christian et al. |
| D431,273 | S | 9/2000 | Burger |
| 6,113,508 | A | 9/2000 | Locarno et al. |
| 6,117,029 | A | 9/2000 | Kunisaki et al. |
| 6,129,962 | A | 10/2000 | Quigley et al. |
| 6,152,840 | A | 11/2000 | Baum |
| 6,155,932 | A | 12/2000 | Cabales et al. |
| 6,176,640 | B1 | 1/2001 | Gonczi |
| 6,183,384 | B1 | 2/2001 | Roberto |
| 6,197,392 | B1 | 3/2001 | Jones |
| 6,203,447 | B1 | 3/2001 | Dillard |
| 6,203,454 | B1 | 3/2001 | Nashif et al. |
| 6,206,793 | B1 | 3/2001 | Burger |
| D440,617 | S | 4/2001 | Goldsmith |
| 6,224,505 | B1 | 5/2001 | Burger |
| 6,234,923 | B1 | 5/2001 | Gentile |
| 6,241,633 | B1 | 6/2001 | Conroy |
| 6,248,031 | B1 | 6/2001 | Brodie |
| 6,250,193 | B1 | 6/2001 | Head |
| 6,257,997 | B1 | 7/2001 | Doble et al. |
| 6,265,475 | B1 | 7/2001 | Chifei et al. |
| 6,267,697 | B1 | 7/2001 | Sulenta |
| 6,273,829 | B1 | 8/2001 | Carlson |
| 6,273,835 | B1 | 8/2001 | Battis et al. |
| 6,274,230 | B1 | 8/2001 | Sarrelongue et al. |
| 6,306,474 | B1 | 10/2001 | Yoshioka et al. |
| 6,352,485 | B1 | 3/2002 | Philpot et al. |
| 6,358,166 | B1 | 3/2002 | Yu |
| 6,364,792 | B1 | 4/2002 | Evanochko |
| 6,364,793 | B1 | 4/2002 | Valarik |
| 6,395,210 | B1 | 5/2002 | Head et al. |
| D458,329 | S | 6/2002 | Clark et al. |
| 6,399,199 | B1 | 6/2002 | Fujino et al. |
| 6,403,504 | B1 | 6/2002 | McMahon et al. |
| 6,500,079 | B1 | 12/2002 | Tucker |
| 6,515,081 | B2 | 2/2003 | Oosedo et al. |
| 6,525,125 | B1 | 2/2003 | Giardello et al. |
| 6,565,280 | B1 | 5/2003 | Post |
| 6,610,382 | B1 | 8/2003 | Kobe et al. |
| 6,612,944 | B1 | 9/2003 | Bureau |
| 6,625,848 | B1 | 9/2003 | Schneider |
| 7,097,577 | B2 | 8/2006 | Goldsmith et al. |
| 7,144,343 | B2 | 12/2006 | Goldsmith et al. |
| 7,232,386 | B2 | 6/2007 | Halko et al. |
| 2001/0018378 | A1 | 8/2001 | Burger |
| 2001/0029813 | A1 | 10/2001 | Schroder |
| 2001/0041633 | A1 | 11/2001 | Tiitola |
| 2001/0046909 | A1* | 11/2001 | Pagotto ..... 473/563 |
| 2001/0046910 | A1 | 11/2001 | Sutherland |
| 2002/0007022 | A1 | 1/2002 | Oosedo et al. |
| 2002/0061374 | A1 | 5/2002 | O'Brien |
| 2002/0073620 | A1 | 6/2002 | Lank |
| 2002/0094891 | A1 | 7/2002 | Horwood et al. |
| 2002/0098924 | A1 | 7/2002 | Houser et al. |
| 2002/0107095 | A1 | 8/2002 | Becker |
| 2002/0128093 | A1 | 9/2002 | Whayne |
| 2002/0166595 | A1 | 11/2002 | Lindsay |
| 2002/0177497 | A1 | 11/2002 | Westerlund |
| 2002/0198071 | A1 | 12/2002 | Snow |
| 2003/0004019 | A1 | 1/2003 | Lussier et al. |
| 2003/0008734 | A1 | 1/2003 | Tiitola |
| 2003/0045380 | A1 | 3/2003 | Tucker |
| 2003/0084756 | A1 | 5/2003 | Schroder et al. |
| 2003/0104152 | A1 | 6/2003 | Sommer |
| 2003/0123917 | A1 | 7/2003 | Willat et al. |
| 2003/0144071 | A1 | 7/2003 | Dodge et al. |
| 2003/0148836 | A1 | 8/2003 | Falone et al. |
| 2004/0102263 | A1 | 5/2004 | Blotteaux |
| 2004/0127310 | A1 | 7/2004 | Hsu |

FOREIGN PATENT DOCUMENTS

| | | |
|---|---|---|
| CA | 557838 | 5/1958 |
| CA | 633295 | 12/1961 |
| CA | 903285 | 6/1972 |
| CA | 1043065 | 11/1978 |
| CA | 1043379 | 11/1978 |
| CA | 1047561 | 1/1979 |
| CA | 1063747 | 10/1979 |
| CA | 1069147 | 1/1980 |
| CA | 1072142 | 2/1980 |
| CA | 1138912 | 1/1983 |
| CA | 1145371 | 4/1983 |
| CA | 1147767 | 6/1983 |
| CA | 1151693 | 8/1983 |
| CA | 1180728 | 1/1985 |
| CA | 1183883 | 3/1985 |
| CA | 1187525 | 5/1985 |
| CA | 1205835 | 6/1986 |
| CA | 1206309 | 6/1986 |
| CA | 1206497 | 6/1986 |
| CA | 1207350 | 7/1986 |
| CA | 1219886 | 3/1987 |
| CA | 1230898 | 12/1987 |
| CA | 2071859 A1 | 6/1991 |
| CA | 2029109 A1 | 2/1992 |
| CA | 2037273 A1 | 8/1992 |
| CA | 2066476 A1 | 10/1992 |
| CA | 1310674 | 11/1992 |
| CA | 2071022 A1 | 12/1992 |
| CA | 2099853 A1 | 7/1993 |
| CA | 2062635 A1 | 9/1993 |
| CA | 2067087 A1 | 10/1993 |
| CA | 2105797 A1 | 11/1993 |
| CA | 1328892 | 4/1994 |

| | | | |
|---|---|---|---|
| CA | 2081439 | A1 | 4/1994 |
| CA | 2086470 | | 4/1994 |
| CA | 2125343 | A1 | 7/1994 |
| CA | 2088899 | A1 | 8/1994 |
| CA | 2120809 | A1 | 10/1994 |
| CA | 2096304 | | 11/1994 |
| CA | 2108069 | A1 | 4/1995 |
| CA | 2132567 | A1 | 7/1995 |
| CA | 2123248 | A1 | 10/1995 |
| CA | 2204021 | A1 | 5/1996 |
| CA | 2169216 | A1 | 8/1996 |
| CA | 2162444 | A1 | 12/1996 |
| CA | 2226670 | A1 | 2/1997 |
| CA | 2160731 | A1 | 4/1997 |
| CA | 2164188 | A1 | 5/1997 |
| CA | 2200663 | A1 | 9/1997 |
| CA | 2180893 | A1 | 1/1998 |
| CA | 2223098 | | 3/1998 |
| CA | 2190431 | A1 | 5/1998 |
| CA | 2228104 | A1 | 9/1998 |
| CA | 2294864 | A1 | 9/1998 |
| CA | 2202454 | A1 | 10/1998 |
| CA | 2238291 | A1 | 2/1999 |
| CA | 2244610 | A1 | 2/1999 |
| CA | 2262210 | A1 | 8/1999 |
| CA | 2272497 | A1 | 12/1999 |
| CA | 2294301 | A1 | 1/2000 |
| CA | 2310802 | A1 | 2/2001 |
| CA | 2289988 | A1 | 5/2001 |
| CA | 2326966 | A1 | 6/2001 |
| CA | 2329228 | A1 | 6/2001 |
| CA | 2293950 | A1 | 7/2001 |
| CA | 2324063 | A1 | 2/2002 |
| CA | 2357331 | A1 | 3/2002 |
| CA | 2359410 | A1 | 4/2002 |
| DE | 376009 | | 12/1921 |
| DE | 3238117 | A1 | 6/1983 |
| EP | 0 172 564 | A2 | 2/1986 |
| EP | 0 172 564 | A3 | 2/1986 |
| EP | 0 226 420 | A2 | 6/1987 |
| EP | 0 226 420 | A3 | 6/1987 |
| EP | 0 226 420 | B1 | 6/1987 |
| EP | 0 310 203 | A1 | 4/1989 |
| EP | 0 351 201 | A2 | 1/1990 |
| EP | 0 407 996 | A2 | 1/1991 |
| EP | 0 407 996 | A3 | 1/1991 |
| EP | 0 407 996 | B1 | 1/1991 |
| EP | 0 441 971 | A1 | 8/1991 |
| EP | 0 441 971 | B1 | 8/1991 |
| EP | 0 441 971 | B2 | 8/1991 |
| EP | 0 487 549 | B1 | 6/1992 |
| EP | 0 504 230 | B1 | 9/1992 |
| EP | 0 523 913 | A1 | 1/1993 |
| EP | 0 532 444 | A1 | 3/1993 |
| EP | 0 585 965 | A1 | 3/1994 |
| EP | 0 597 166 | A2 | 5/1994 |
| EP | 0 597 166 | A3 | 5/1994 |
| EP | 0 597 166 | B1 | 5/1994 |
| EP | 0 662 391 | A2 | 7/1995 |
| EP | 0 662 391 | A3 | 7/1995 |
| EP | 0 733 469 | A2 | 9/1996 |
| EP | 0 733 469 | A3 | 9/1996 |
| EP | 0 733 469 | B1 | 9/1996 |
| EP | 0 742 266 | A2 | 11/1996 |
| EP | 0 742 266 | A3 | 11/1996 |
| EP | 0 764 453 | A1 | 3/1997 |
| EP | 0 927 628 | A1 | 7/1999 |
| EP | 0 947 562 | A1 | 10/1999 |
| EP | 0 970 708 | A1 | 1/2000 |
| EP | 0 693 944 | B1 | 4/2000 |
| EP | 1 068 884 | A2 | 1/2001 |
| EP | 1 086 724 | A1 | 3/2001 |
| FI | 65018 | | 11/1983 |
| GB | 637779 | | 5/1950 |
| GB | 1121051 | | 7/1968 |
| SE | 169928 | | 12/1959 |
| WO | WO 82/03789 | A1 | 11/1982 |
| WO | WO 90/15712 | A1 | 12/1990 |
| WO | WO 91/08803 | A1 | 6/1991 |
| WO | WO 91/16955 | A1 | 11/1991 |
| WO | WO 93/05219 | A1 | 3/1993 |
| WO | WO 94/21334 | A1 | 9/1994 |
| WO | WO 94/23768 | A1 | 10/1994 |
| WO | WO 95/01820 | A1 | 1/1995 |
| WO | WO 95/24245 | A1 | 9/1995 |
| WO | WO 96/01137 | A1 | 1/1996 |
| WO | WO 96/01699 | A1 | 1/1996 |
| WO | WO 96/02385 | A1 | 2/1996 |
| WO | WO 96/13549 | A2 | 5/1996 |
| WO | WO 97/03730 | A1 | 2/1997 |
| WO | WO 97/03820 | A1 | 2/1997 |
| WO | WO 97/29808 | A1 | 8/1997 |
| WO | WO 97/33660 | A1 | 9/1997 |
| WO | WO 97/41929 | A2 | 11/1997 |
| WO | WO 98/01189 | A1 | 1/1998 |
| WO | WO 98/19753 | A1 | 5/1998 |
| WO | WO 98/24616 | A1 | 6/1998 |
| WO | WO 98/41292 | A1 | 9/1998 |
| WO | WO 98/55182 | A2 | 12/1998 |
| WO | WO 99/17845 | A1 | 4/1999 |
| WO | WO 99/32198 | A1 | 7/1999 |
| WO | WO 99/60030 | A1 | 11/1999 |
| WO | WO 00/03769 | A1 | 1/2000 |
| WO | WO 00/09222 | A2 | 2/2000 |
| WO | WO 00/10655 | A1 | 3/2000 |
| WO | WO 00/27632 | A1 | 5/2000 |
| WO | WO 00/32278 | A1 | 6/2000 |
| WO | WO 00/46255 | A1 | 8/2000 |
| WO | WO 01/14019 | A1 | 3/2001 |
| WO | WO 01/26752 | A1 | 4/2001 |
| WO | WO 01/43838 | A1 | 6/2001 |
| WO | WO 01/47605 | A2 | 7/2001 |
| WO | WO 01/97990 | A2 | 12/2001 |
| WO | WO 02/04078 | A1 | 1/2002 |
| WO | WO 02/13638 | A2 | 2/2002 |
| WO | WO 02/35184 | A2 | 5/2002 |
| WO | WO 02/070080 | A1 | 9/2002 |
| WO | WO 02/089926 | A1 | 11/2002 |
| WO | WO 2005/082470 | A1 | 9/2005 |

* cited by examiner

HOCKEY STICK

RELATED APPLICATIONS

This application is a divisional of U.S. patent application Ser. No. 10/689,545 filed Oct. 20, 2003, now U.S. Pat. No. 7,232,386, which is a continuation-in-part of U.S. patent application Ser. No. 10/439,652 filed May 15, 2003, now pending, the disclosures of which are hereby incorporated by reference.

FIELD OF THE INVENTION

The field of the present invention generally relates to hockey sticks including hockey stick configurations, manufacture and component structures and combinations thereof.

BACKGROUND OF THE INVENTION

Generally, hockey sticks are comprised of a blade portion and an elongated shaft portion. Traditionally, each portion was constructed of wood (e.g., solid wood, wood laminates) and attached together at a permanent joint. The joint generally comprised a slot formed by two opposing sides of the lower end section of the shaft with the slot opening on the forward facing surface of the shaft. As used in this application "forward facing surface of the shaft" means the surface of the shaft that faces generally toward the tip of the blade and is generally perpendicular to the longitudinal length of the blade at the point of attachment. The heel of the blade comprised a recessed portion dimensioned to be receivable within the slot. Upon insertion of the blade into the slot, the opposing sides of the shaft that form the slot overlap the recessed portion of the blade at the heel. The joint was made permanent by application of a suitable bonding material or glue between the shaft and the blade. In addition, the joint was oftentimes further strengthened by an overlay of fiberglass material.

Traditional wood hockey stick constructions, however, are expensive to manufacture due to the cost of suitable wood and the manufacturing processes employed. In addition, due to the wood construction, the weight may be considerable. Moreover, wood sticks lacked durability, often due to fractures in the blade, thus requiring frequent replacement. Furthermore, due to the variables relating to wood construction and manufacturing techniques, wood sticks were often difficult to manufacture to consistent tolerances. For example, the curve and flex of the blade often varied even within the same model and brand of stick. Consequently, a player after becoming accustomed to a particular wood stick was often without a comfortably seamless replacement when the stick was no longer in a useable condition.

Notwithstanding, the "feel" of traditional wood-constructed hockey sticks was found desirable by many players. The "feel" of a hockey stick can vary depending on a myriad of objective and subjective factors including the type of construction materials employed, the structure of the components, the dimensions of the components, the rigidity or bending stiffness of the shaft and/or blade, the weight and balance of the shaft and/or blade, the rigidity and strength of the joint(s) connecting the shaft to the blade, the curvature of the blade, the sound that is made when the blade strikes the puck, etc. Experienced players and the public are often inclined to use hockey sticks that have a "feel" that is comfortable yet provides the desired performance. Moreover, the subjective nature inherent in this decision often results in one hockey player preferring a certain "feel" of a particular hockey stick while another hockey player prefers the "feel" of another hockey stick.

Perhaps due to the deficiencies relating to traditional wood hockey stick constructions, contemporary hockey stick design veered away from the traditional permanently attached blade configuration toward a replaceable blade and shaft configuration, wherein the blade portion was configured to include a connection member, often referred to as a "tennon", "shank" or "hosel", which generally comprised of an upward extension of the blade from the heel. The shafts of these contemporary designs generally were configured to include a four-sided tubular member having a connection portion comprising a socket (e.g., the hollow at the end of the tubular shaft) appropriately configured or otherwise dimensioned so that it may slidably and snugly receive the connection member of the blade. Hence, the resulting joint generally comprised a four-plane lap joint. In order to facilitate the detachable connection between the blade and the shaft and to further strengthen the integrity of the joint, a suitable bonding material or glue is typically employed. Notable in these contemporary replaceable blade and shaft configurations is that the point of attachment between the blade and the shaft is substantially elevated relative to the heel attachment employed in traditional wood type constructions.

Although over the years, metallic materials such as aluminum were employed to form tubular shafts adapted to being joined to replaceable blades in the manner described above; in more recent years the hockey stick industry has tended to make more and more hockey stick shafts from composite materials. Such shafts, for example, have been manufactured via pulltrusion or by wrapping layers of composite fibers over a mandrel and then curing so that the fibers reside in a hardened resin matrix. Although, composite hockey stick shafts are much appreciated by players for their performance attributes, applicants have found that they tend to transmit undesirable vibration more efficiently to the player's hands than did traditional wood constructed hockey sticks.

Contemporary replaceable blades, of the type discussed above, are constructed of various materials including wood, wood laminates, wood laminate overlain with fiberglass, and what is often referred to in the industry as "composite" constructions. Such composite blade constructions employ what is generally referred to as a structural sandwich construction, which comprises a low-density rigid core faced on generally opposed front and back facing surfaces with a thin, high strength, skin or facing. The skin or facing is typically comprised of plies of woven and substantially continuous fibers, such as carbon, glass, graphite, or Kevlar™ disposed within a hardened matrix resin material. Of particular importance in this type of construction is that the core is strongly or firmly attached to the facings and is formed of a material composition that, when so attached, rigidly holds and separates the opposing faces. The improvement in strength and stiffness, relative to the weight of the structure, that is achievable by virtue of such structural sandwich constructions has found wide appeal in the industry and is widely employed by hockey stick blade manufacturers.

Contemporary composite blades are typically manufactured by employment of a resin transfer molding (RTM) process, which generally involves the following steps. First, a plurality of inner core elements composed of compressed foam, such as those made of polyurethane, are individually and together inserted into one or more woven-fiber sleeves to form an uncured blade assembly. The uncured blade assembly, including the hosel or connection member, is then inserted into a mold having the desired exterior shape of the blade. After the mold is sealed, a suitable matrix material or resin is injected into the mold to impregnate the woven-fiber sleeves. The blade assembly is then cured for a requisite time and temperature, removed from the mold, and finished. The curing of the resin serves to encapsulate the fibers within a rigid surface layer and hence facilitates the transfer of load among the fibers, thereby improving the strength of the surface layer. In addition, the curing process serves to attach the rigid foam core to the opposing faces of the blade to create—at least initially—the rigid structural sandwich construction.

Experience has shown that considerable manufacturing costs are expended on the woven-fiber sleeve materials themselves, and in impregnating those fiber sleeves with resin while the uncured blade assembly is in the mold. Moreover, the process of managing resin flow to impregnate the various fiber sleeves, has been found to, represent a potential source of manufacturing inconsistency. In addition, as was the case with composite shaft constructs, such composite blade constructs tend to transmit undesirable vibrations to the player's hands, especially when coupled to a composite shaft. In this regard, commonly owned U.S. patent application Ser. No. 10/439,652 filed on May 15, 2003, hereby incorporated by reference, teaches a hockey stick construction comprising a composite blade construct having one or more core elements formed of a resilient elastomer material (e.g., rubber) which may serve to dampen vibration, while also providing desirable performance attributes.

Composite shafts and blades, nonetheless, are thought to have certain advantages over wood shafts and blade. For example, composite blades and shafts may be more readily manufactured to consistent tolerances and are generally more durable than their wood counterparts. In addition, such composite constructs are capable of providing improved strength and hence may be made lighter.

Notwithstanding, such constructions nevertheless also have been found by applicants to produce a "feel" and/or performance attributes (e.g., vibration, sound, flex) that are unappealing to some players. Even players that choose to play with composite hockey sticks continually seek out alternative sticks having improved feel or performance. Moreover, despite the advent of contemporary composite hockey stick constructions and two-piece replaceable blade-shaft configurations, traditional wood-constructed hockey sticks are still preferred by many players notwithstanding the drawbacks noted above. In an on going effort to improve the state of the technology, applicants disclose unique composite hockey stick configurations and constructions that may overcome one or more of these deficiencies.

SUMMARY OF THE INVENTION

The present invention relates to hockey sticks, their manufacture, configuration and component structures. Various aspects are set forth below.

In one aspect, a hockey stick comprises a tubular hollow rectangular shaft having an outer layer and inner layer formed of composite molded around an elastomer middle layer. The elastomer middle layer may be positioned any where along the longitudinal length of the shaft, however, it is contemplated that the elastomer layer be configured reside nearer the blade of the hockey stick within preferred positions described herein. Similarly, although it contemplated that the elastomer middle layer form at least a portion of each of the four walls that comprise the rectangular shaft, the middle elastomer layer may form any one of the four walls or all of the four walls or any combination of one or more of the four walls.

In another aspect, a method for manufacturing a composite hockey stick blade is disclosed comprising (a) providing a cured tubular shaft, such as the one previously set forth above, (b) providing an un-cured composite blade comprising one or more core elements wrapped with one or plies of fibers dimensioned to receive the lower portion of the hockey stick shaft, (c) inserting the cured shaft into the un-cured hockey stick blade, and (d) curing the composite blade around the cured hockey stick shaft.

Additional implementations, features, variations, and advantageous of the invention will be set forth in the description that follows, and will be further evident from the illustrations set forth in the accompanying drawings.

BRIEF DESCRIPTION OF THE DRAWINGS

The accompanying drawings illustrate presently contemplated embodiments and constructions of the invention and, together with the description, serve to explain various principles of the invention.

DETAILED DESCRIPTION OF THE PREFERRED EMBODIMENTS

Figure 3:
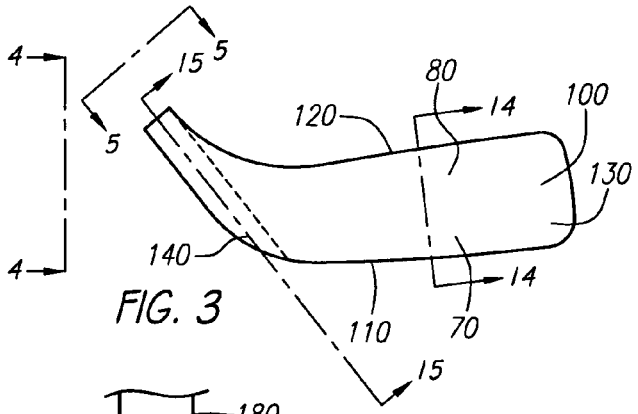
FIG. 3 is a back face view of the hockey stick blade illustrated in FIG. 1 detached from the hockey stick shaft.

The preferred embodiments will now be described with reference to the drawings. To facilitate description, any reference numeral designating an element in one figure will designate the same element if used in any other figure. The following description of the preferred embodiments is only exemplary. The present invention(s) is not limited to these embodiments, but may be realized by other implementations. Furthermore, in describing preferred embodiments, specific terminology is resorted to for the sake of clarity. However, the invention is not intended to be limited to the specific terms so selected, and it is to be understood that each specific term includes all equivalents.

Figure 2:
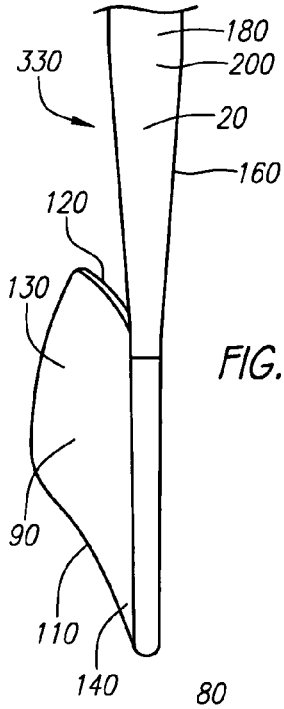
FIG. 2 is a rear view of a lower portion of the hockey stick illustrated in FIG. 1
Figure 1:
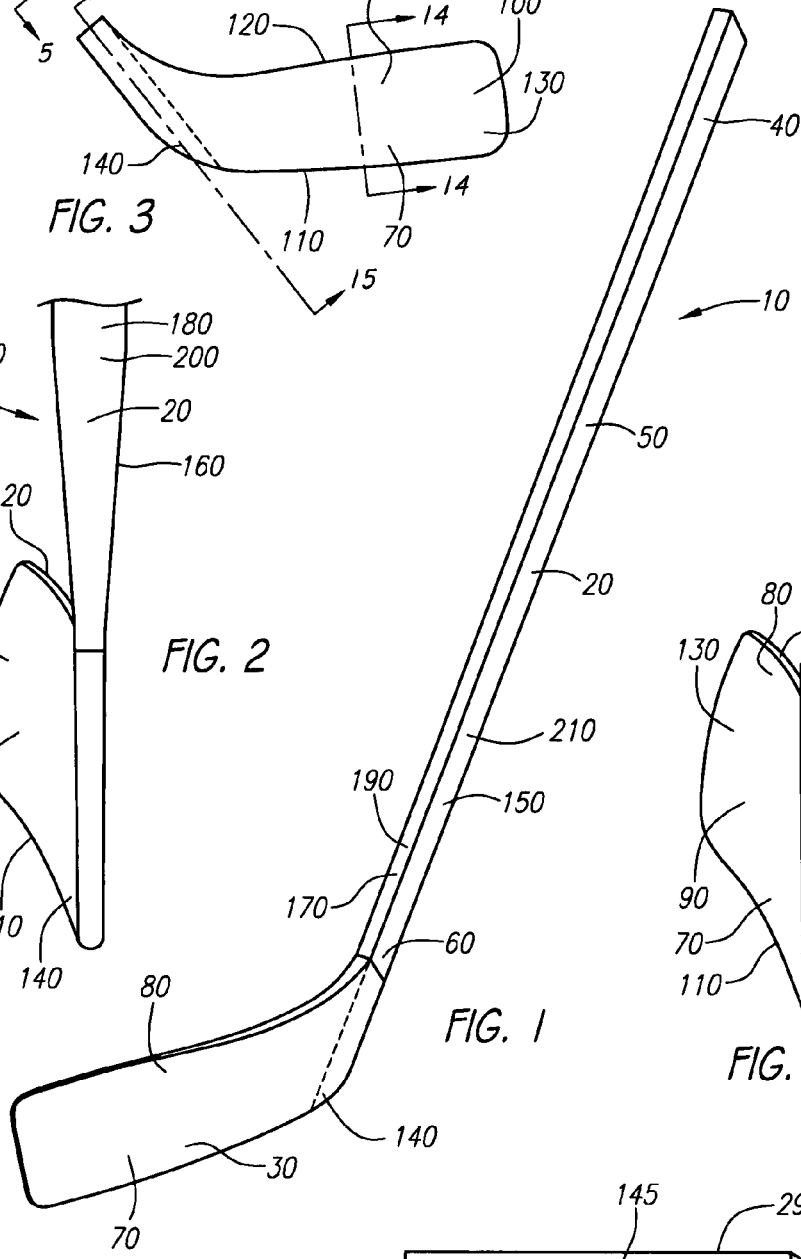
FIG. 1 is a diagram illustrating a representative hockey stick configuration.
Figure 4:
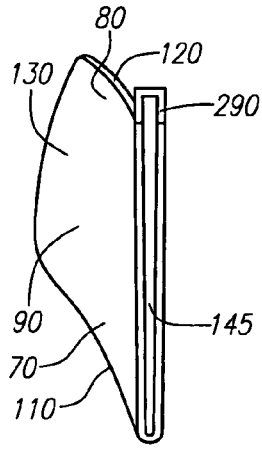
FIG. 4 is a rear view illustration taken along line 4-4 of the hockey stick blade illustrated in FIG. 3.
Figure 5:
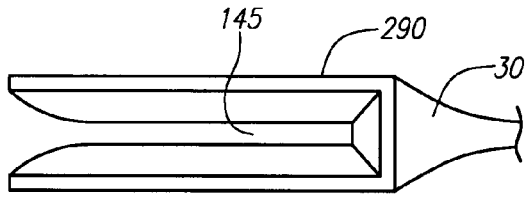
FIG. 5 is a top view illustration taken along line 5-5 of the hockey stick blade illustrated in FIG. 3.
Figure 6:
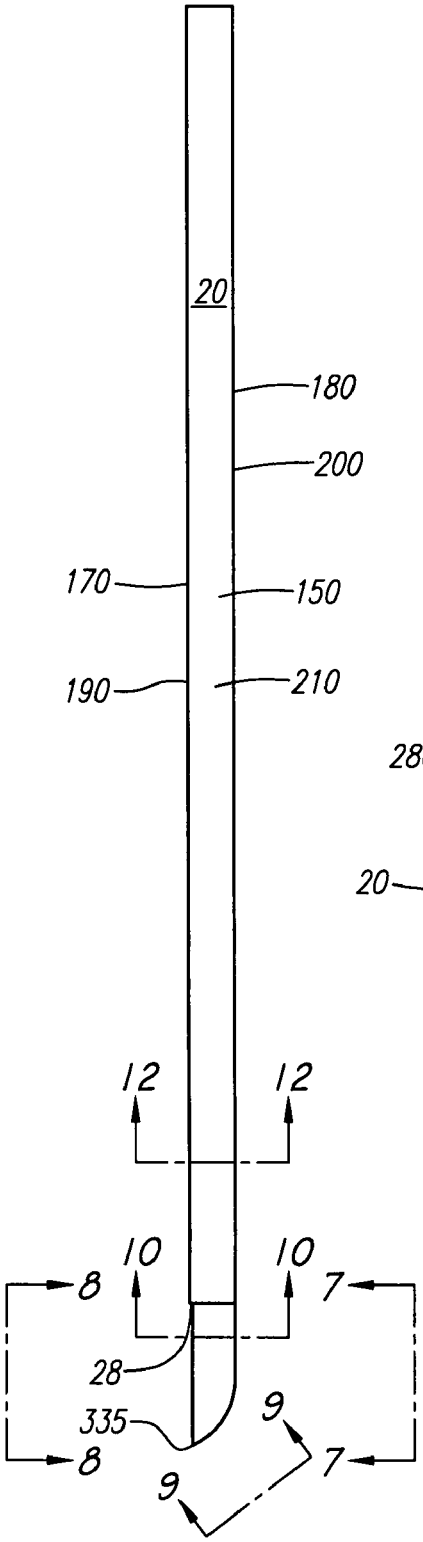
FIG. 6 is a front side view of the hockey stick shaft illustrated in FIG. 1 detached from the blade.
Figure 8:
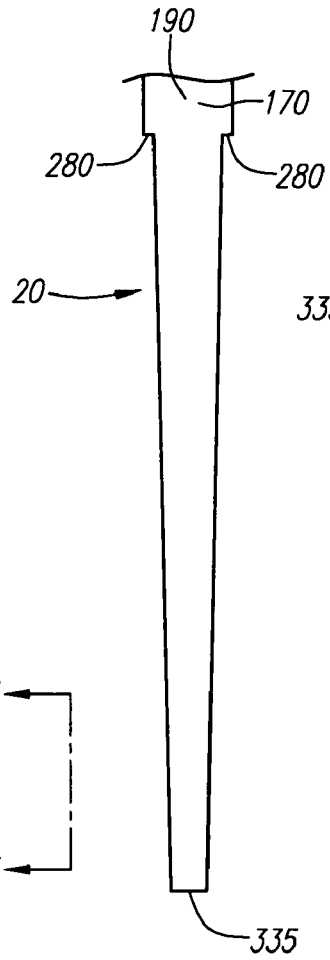
FIG. 8 is an enlarged partial front view of the hockey stick shaft illustrated in FIG. 6.
Figure 7:
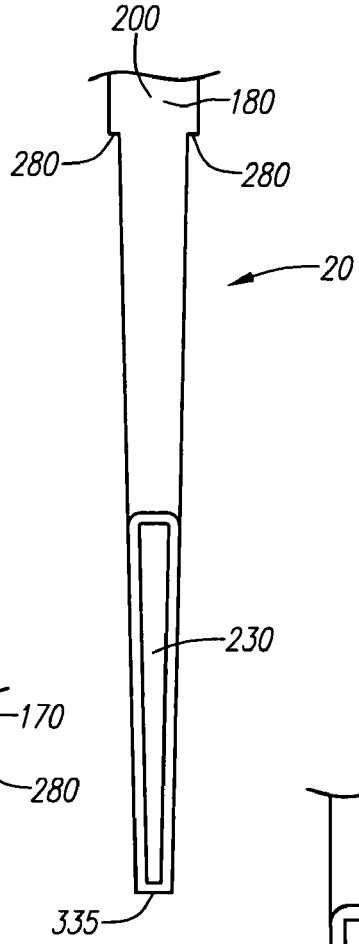
FIG. 7 is an enlarged partial rear view of the hockey stick shaft illustrated in FIG. 6.
Figure 9:
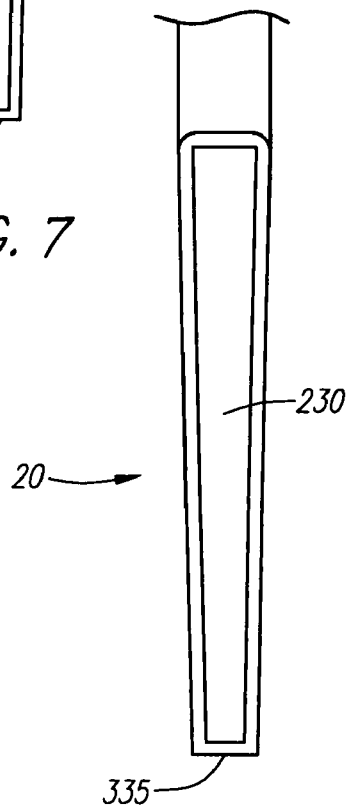
FIG. 9 is an enlarged bottom end view of the hockey stick shaft illustrated in FIG. 6
Figure 10:
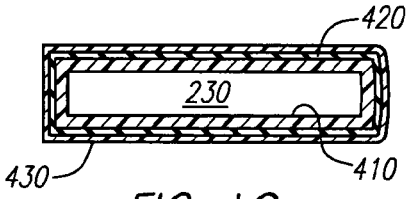
FIG. 10 is a cross-sectional view of the hockey stick shaft illustrated in FIG. 6 taken along line 10-10.
Figure 11:
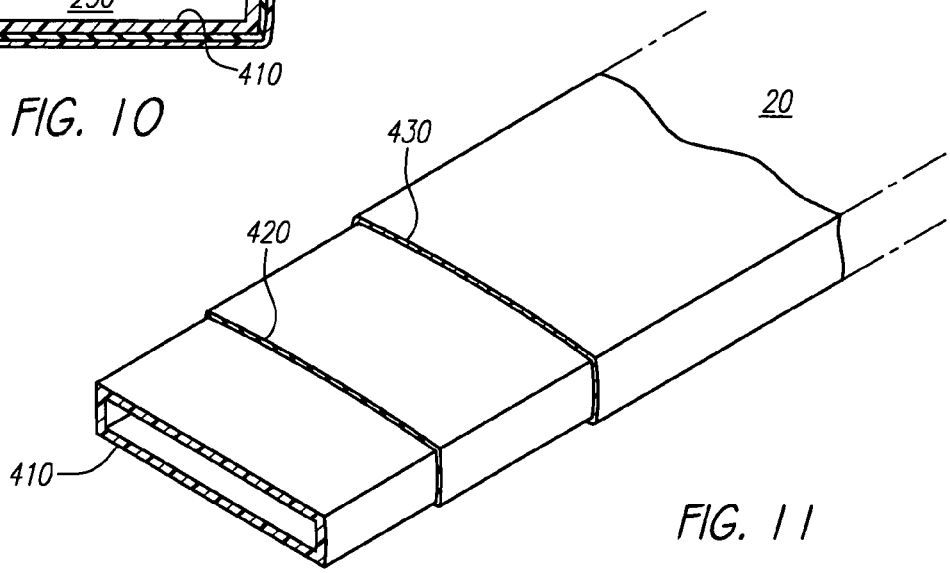
FIG. 11 is an enlarged perspective view of the cross-section illustrated in FIG. 11, showing the composite structure of lay-up of the shaft at line 10-10, with successive layers serially exposed.
Figure 12:
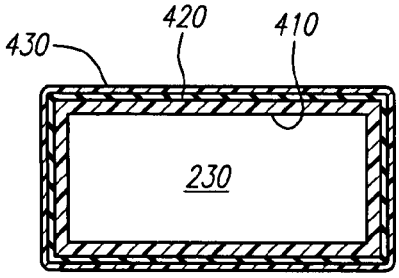
FIG. 12 is a cross-sectional view of the hockey stick shaft illustrated in FIG. 6 taken along line 11-11.
Figure 13:
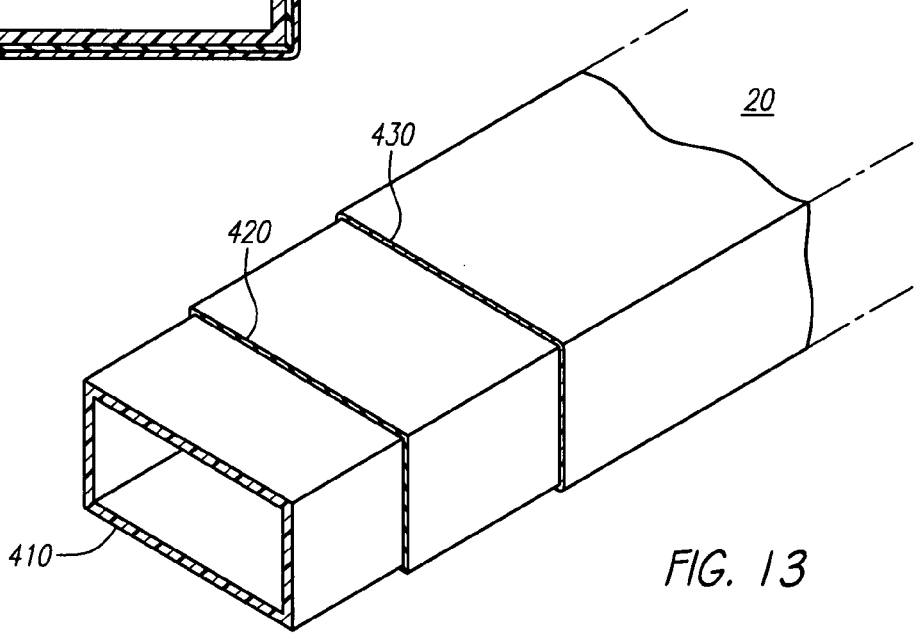
FIG. 13 is an enlarged perspective view of the cross-section illustrated in FIG. 11, showing the composite structure of a preferred lay-up of the shaft at line 11-11, with successive layers serially exposed.
Figure 14:
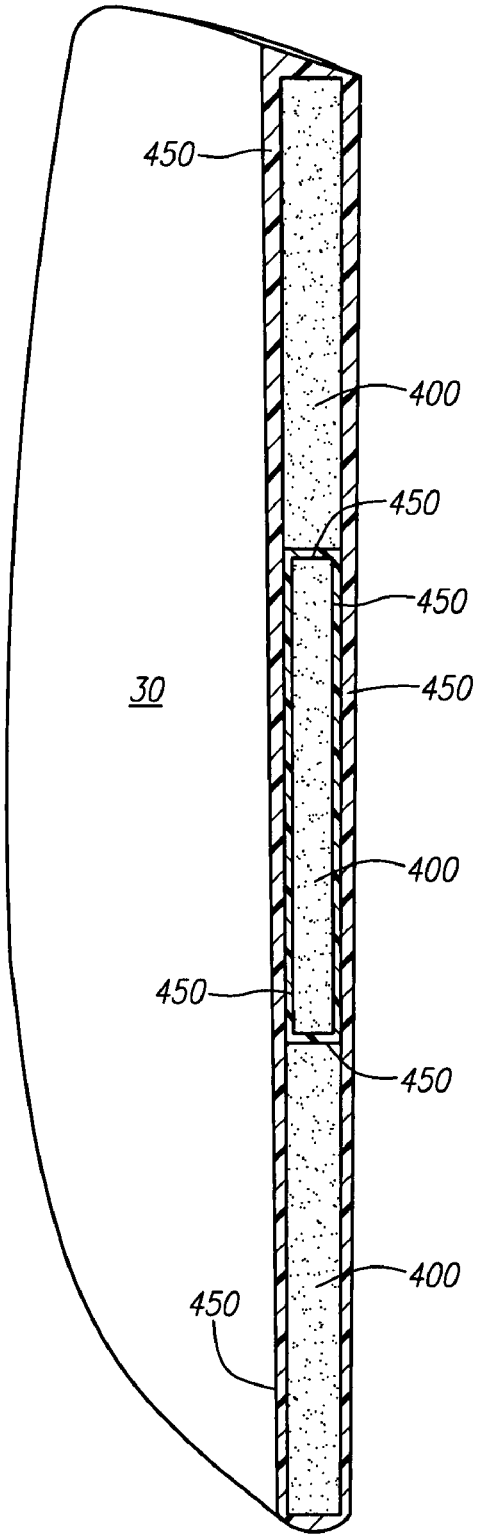
FIG. 14 is a representative cross-sectional view taken along line 14-14 of FIG. 3 illustrating the internal construction of the detached hockey stick blade at the mid-region.
Figure 15:
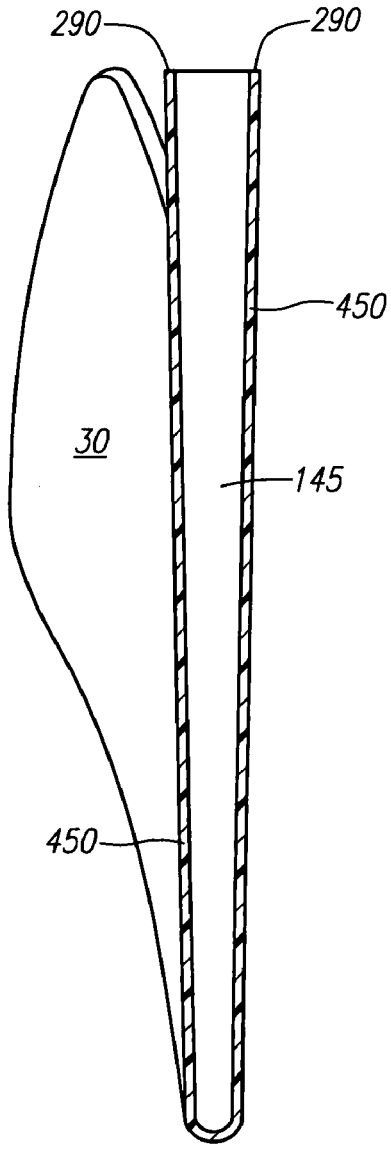
FIG. 15 is a representative cross-sectional view taken along line 15-15 of FIG. 3 illustrating the internal construction of the hockey stick blade at the heel region.
Figure 16A:
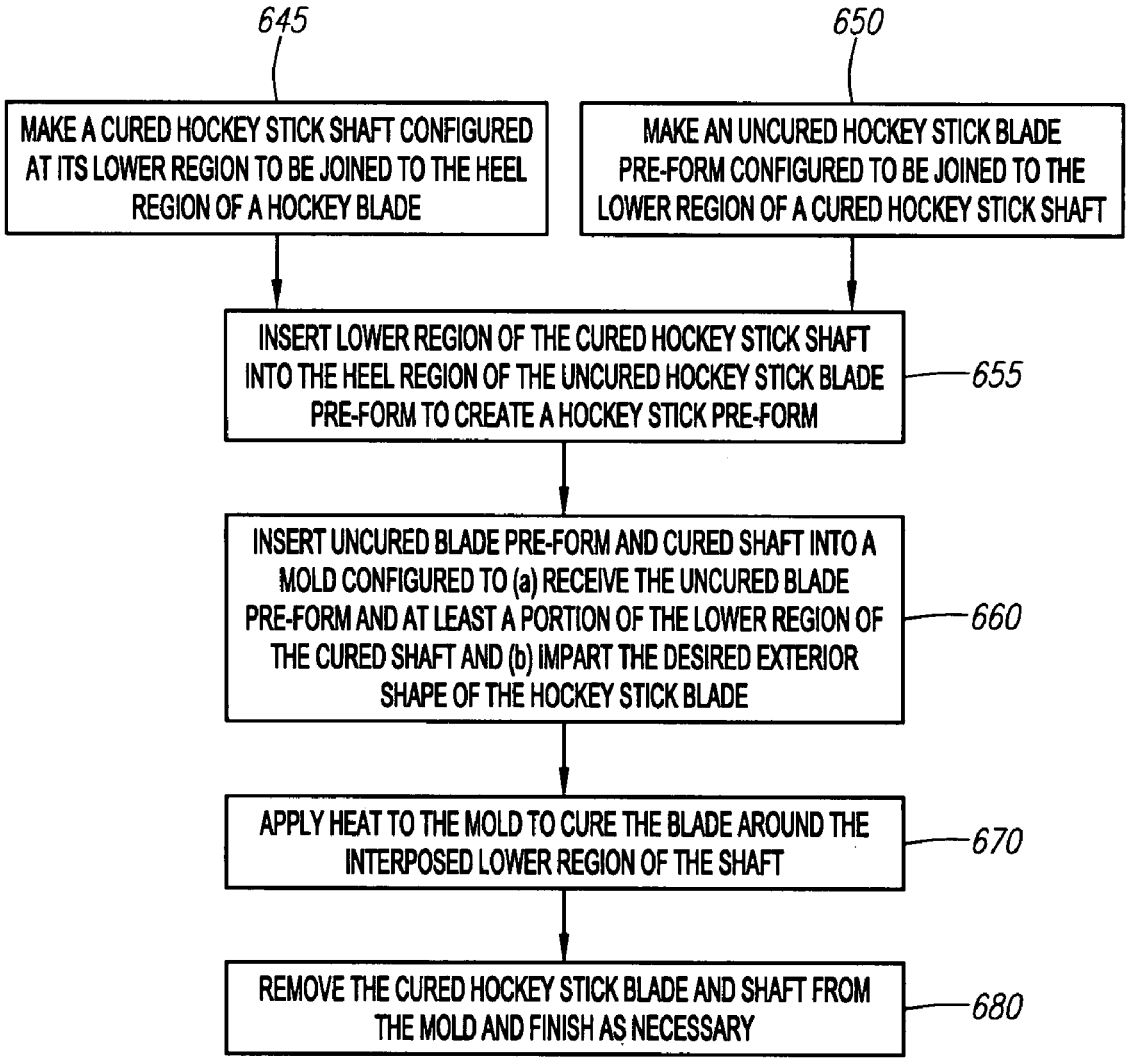
FIGS. 16A-C are flow charts detailing preferred steps for manufacturing the hockey stick illustrated in FIGS. 1-15 and the component elements thereof.
Figure 16B:
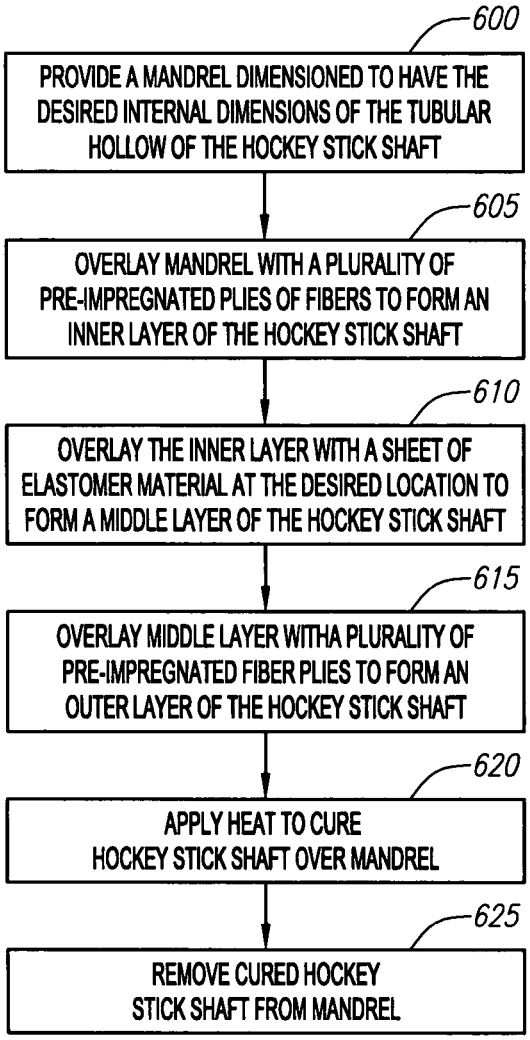
Figure 16C:
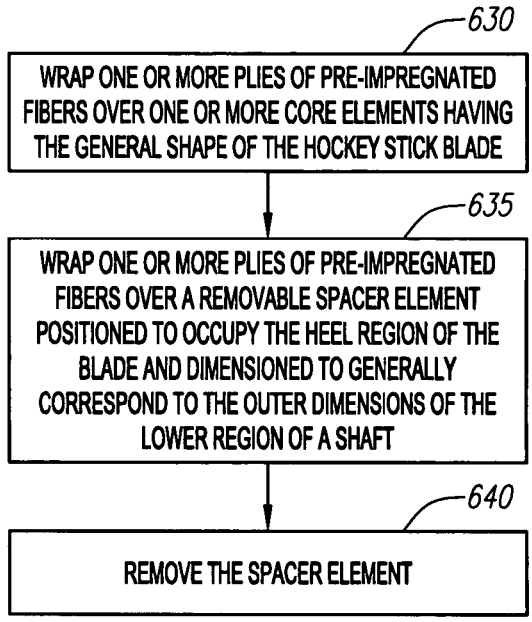
Figure 19:
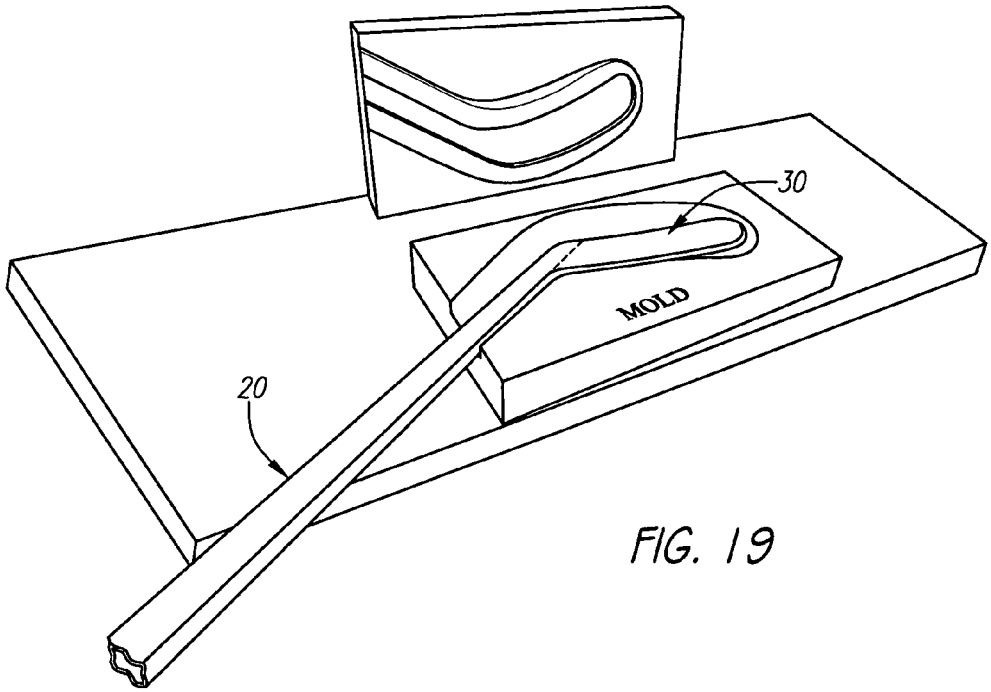
FIG. 19 is a diagram of the uncured hockey stick blade and the cured hockey stick shaft assembled in the open mold prior to curing.
Figure 20:
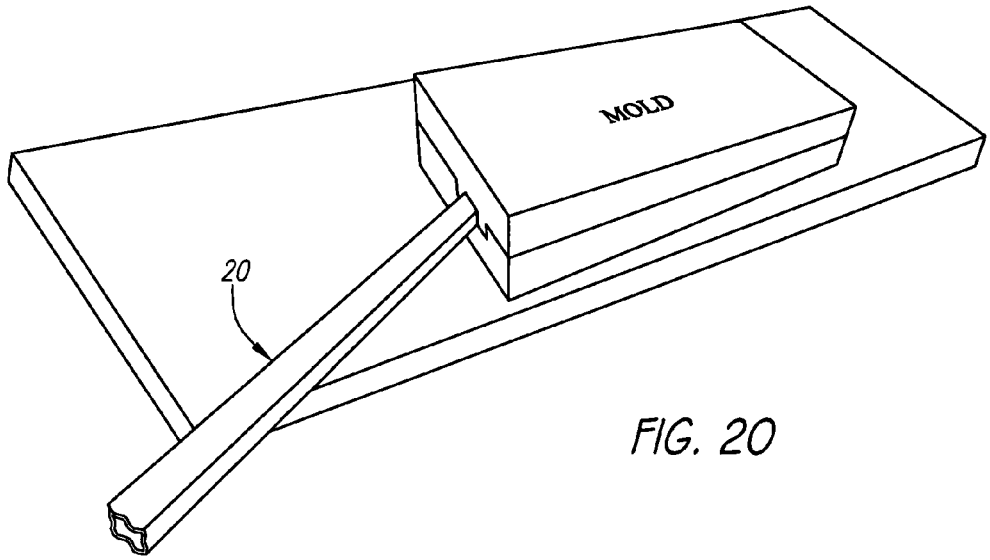
FIG. 20 is a diagram of the uncured hockey stick blade and the cured hockey stick shaft assembled in the closed mold prior to curing.
Figure 21:
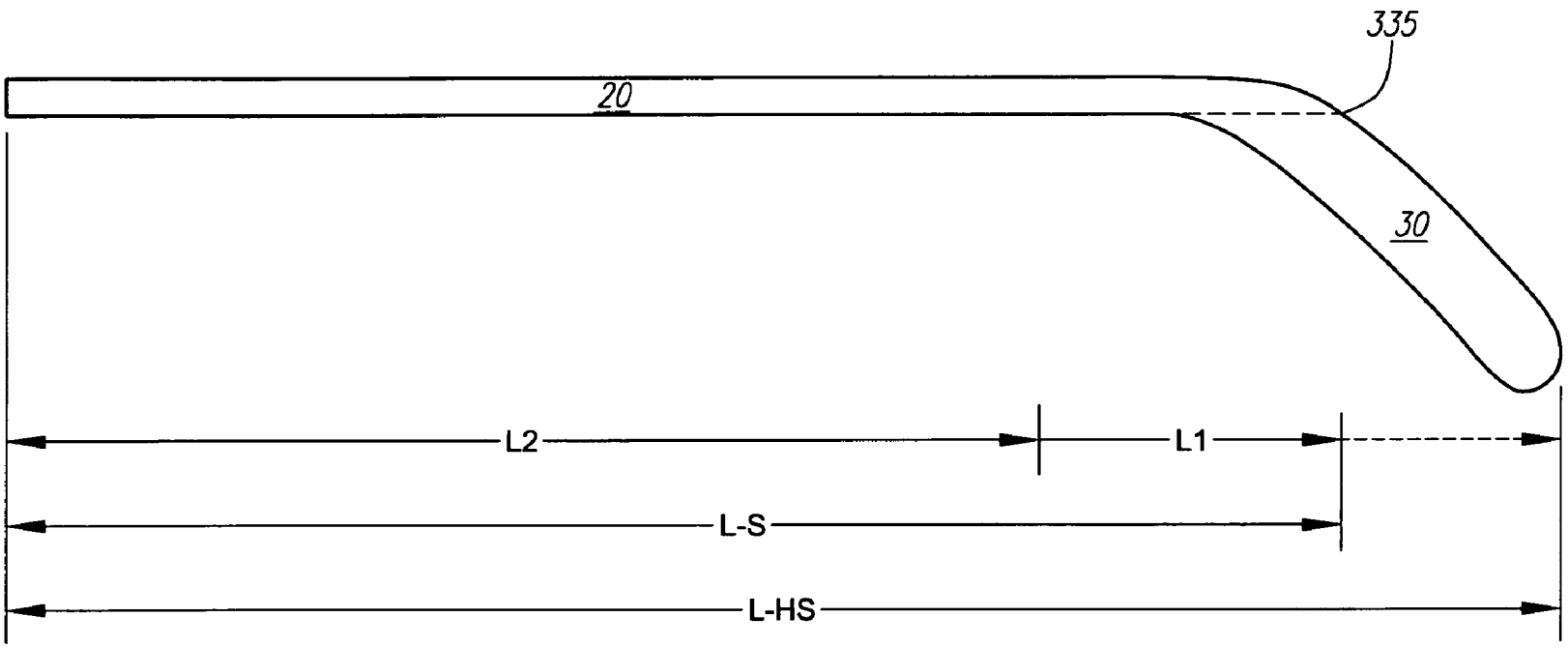
FIG. 21 is a front side view diagram of the hockey stick illustrated in FIG. 1 illustrating the length of the hockey stick (L-HS) and the length of the hockey stick shaft (L-S) and longitudinal distances (L1 and L2) for placement of elastomer layer in the shaft.

FIGS. 1-21 are diagrams illustrating the configuration, structure, construction, and manufacture of a representative hockey stick 10 and components thereof. Generally FIGS. 1 and 2 illustrate the representative hockey stick 10 comprising a shaft 20 and the blade 30 joined to one another; FIGS. 3-5 illustrate the external configuration of the blade 30 detached from the shaft 20; FIGS. 14-15 illustrate the internal configuration and structure of the blade 30; FIGS. 6-9 illustrate the external configuration of the shaft 20 detached from the blade 30; FIGS. 10-13 illustrate the internal configuration and structure of the shaft 20, FIGS. 16*a*-16*c* are flow charts detailing preferred steps for manufacturing the representative hockey stick 10; FIGS. 17-20 are diagrams illustrating various aspects of the manufacturing process set forth in FIGS. 16*a*-16*c* and also further illustrate the structure and construction of the shaft 20 and blade 30, and lastly FIG. 21 is a diagram employed in conjunction with describing presently preferred locations of the elastomer middle layer (described in more detail below) along the longitudinal length of the shaft 20 of the representative hockey stick 10. Each of the figures is further described in detail below in the foregoing order.

FIGS. 1 and 2 are diagrams illustrating a representative hockey stick 10 configuration comprising a blade 30 and a shaft 20 joined thereto. Externally, the blade 30 comprises a lower section 70, an upper section 80, a front face wall 90, a back face wall 100, a bottom edge 110, a top edge 120, a tip section 130, and a heel section 140, which generally resides behind the tip section 130 of the blade 30 between the plane defined by the top edge 120 and the plane defined by the bottom edge 110 of the blade 30. The heel section 140 of the blade 30 includes a slot 145 that extends internally between the front face wall 90 and back face wall 100 of the blade 30 and tapers or narrows as it extends from between the top edge 120 toward the bottom edge 110 of the blade 30 (best illustrated in FIG. 5). The internal construction of the blade 30 is described in more detail in subsequent portions of this description in relation to FIGS. 14 and 15 and the manufacturing process described in relation to FIGS. 16*a*-16*c* and 17-20.

The shaft 20 comprises an upper section 40, a mid-section 50, and a lower section 60, which is adapted to being interposed or joined within the slot 145 located in the heel section 140 of the blade 30 between the front face wall 90 and back face wall 100 of the blade 30. In the preferred embodiment, illustrated in the drawings, the shaft 20 is generally rectangular in cross-section with two wide opposed walls 150 and 160 and two narrow opposed walls 170 and 180. Narrow wall 170 includes a forward-facing surface 190 and narrow wall 180 includes a rearward-facing surface 200. The forward-facing surface 190 faces generally toward the tip section 130 of the blade 30 and is generally perpendicular to the longitudinal length of the blade 30 (i.e., the length between the heel section 140 and the tip section 130). The rearward-facing surface 200 faces generally away from the tip section 130 of the blade 30 and is also generally perpendicular to the longitudinal length of the blade 30. Wide wall 150 includes a front-facing surface 210 and wide wall 160 includes a back-facing surface 220. When the shaft 20 is attached to the blade 30 as illustrated in FIGS. 1 and 2, the front-facing surface 210 faces generally in the same direction as the front face wall 90 of the blade 30 and the back-facing surface 220 faces generally in the same direction as the back face wall 100 of the blade 30.

In the preferred embodiment, the shaft 20 includes a tapered section 330 (best illustrated in FIGS. 2, 7 and 8) having a reduced shaft width. The "shaft width" is defined for the purposes of this application as the dimension between the front and back facing surfaces 210 and 220. The tapered section 330 is dimensioned so that, when the shaft 20 is assembled to the blade 30 prior to curing of the blade 30, the portions of the front and back facing surfaces 210, 220 of the shaft 20 configured to being interposed within slot 145 are dimensioned to fit within the slot 145 of the blade 30. The adjacent, more upwardly positioned portions of the front and back facing surfaces 210, 220 of the shaft 20 are dimensioned so that they are flush with the adjacent portions of the front and back face walls 90 and 100 of the blade 30 residing there below.

Hence, the heel section 140 of the blade 30 includes an open-ended slot 145 that is dimensioned to receive the lower portion of the tapered section 330 of the shaft 20 having a reduced width. Corresponding and opposed shoulders 280 and 290 in the shaft 20 and blade 30 configured to reside at the transition there between facilitate the transition between the shaft 20 and the blade 30. Hence, when the shaft 20 is inserted into the slot 145 of the blade 30, shoulders 280 and 290 are configured to be in opposed alignment so that they may abut with one another.

FIGS. 3-5 further illustrate the external configuration of the blade 30, including the slot 145, the front and back facing walls 90 and 100 of the blade 30 that form the slot 145 and the shoulder 290 of the blade 30, which is configured to generally abut with the shoulder 280 of the shaft 20. FIGS. 6-9, on the other hand further illustrate the external configuration of the shaft 20. Notably, in the representative implementation of the hockey stick 10, the shaft 20 is formed as a hollow tubular structure that is defined by opposed wide walls 150 and 160 and opposed narrow walls 170 and 180. The hollow 230 of the shaft 20 is configured, in the representative implementation, to extend generally the full longitudinal length of the shaft 20—from the upper section 40 to the lower section 60, which is tapered as it extends to its conclusion. The taper in the lower section is accomplished by reducing the width of the shaft 20 between the opposed wide walls 150 and 160 or in other words by reducing the width of opposing narrow walls 170 and 180. Notably, the width of the opposing wide walls 150 and 160 of the shaft are, in the representative implementation, generally uniform in dimension as the shaft extends from the upper section 40 toward the lower section 60. However, it is contemplated that the width of wide walls 150 and/or 160 may be varied at any given region.

FIGS. 10-13 illustrate a presently preferred shaft 20 structure. As previously noted, the shaft 20 is generally rectangular hollow tubular structure defined by opposing side walls 150 and 160 and opposing narrow walls 170 and 180. Generally the shaft 20 comprises an inner layer 410, an outer layer 430, and a middle elastomer layer 420. The inner and outer layers 410 and 430 are molded around the middle elastomer layer 420. As best illustrated in FIGS. 10-13, the inner layer 410 is preferably constructed to have a greater cross-sectional thickness than the outer layer 430. A preferred construction of the shaft 20 comprises an inner and outer layers 410 and 430, each of which comprising a plurality of plies of parallel fibers or filaments oriented in one or more defined directions relative to the longitudinal length of the shaft 20 and disposed in a hardened resin matrix. As used herein, the term "ply" shall mean a group of fibers largely parallel to one another and running in a single direction, and which may or may not be interwoven with or stitched to one or more other groups of fibers, of which each group may or may not be oriented in a different direction. Hence a ply may comprise un-directional fibers all running in a single direction, groups of woven or weaved fibers, with one group of fibers running in a first direction parallel with one another and another group of fibers woven or weaved with the first running in a second direction parallel with one another. Unless otherwise defined, a "layer" shall mean one or more plies that are laid down together or over one another to form a definable wall structure.

An exemplary hockey stick shaft lay-up for the inner and outer layers 410 and 430 are set forth in the tables below:

TABLE

Inner Layer Lay-Up

| Fiber Orientation | Fiber | Number of Plies |
|---|---|---|
| +45 | Carbon | 7 |
| −45 | Carbon | 7 |
| 0 | Carbon | 4 Interposed between consecutive +/−45 plies |

TABLE

Outer Layer Lay-Up

| Fiber Orientation (From Inner most ply to Outer most ply) | Fiber | Number of Plies |
|---|---|---|
| 0 | Carbon | 1 |
| +45 | Carbon | 1 |
| −45 | Carbon | 1 |
| 0/90 | Woven Carbon | 1 |
| 0/90 | Woven aramid | 1 |

Hence in a preferred construction of the shaft 20, the inner layer 410 comprises eighteen (18) plies of parallel fibers; whereas the outer layer 430 comprises only five (5) plies of parallel fibers. Hence the outer layer 430 is on the order of approximately ¼ to ⅓ the thickness of the inner layer 410 or in other words the inner layer 410 is three to four times thicker than the outer layer 430. Furthermore, it is noted that the outer most ply of the outer layer 430 is woven.

Although carbon and aramid (such as Kevlar™ manufactured by Dupont Corporation) fibers are employed in the foregoing representative lay-ups of the outer and/or inner layers 430 and 410 of the shaft 20, it is to be understood that other fibers or filaments may be employed. Thus for example, it is contemplated that in addition to carbon and aramid fibers, fibers made of glass, polyethylene (such as Spectra™ manufactured by Allied Signal Corporation), ceramic (such as Nextel™ manufactured by 3m Corporation), boron, quartz, polyester or any other fiber that may provide the desired strength may be employed. Preferably, at least part of one of the fibers is selected from the group consisting of carbon fiber, aramid, glass, polyethylene, ceramic, boron, quartz, and polyester; even more preferably from the group consisting of carbon fiber, aramid, glass, polyethylene, ceramic, boron, and quartz; yet even more preferably from the group consisting of carbon fiber, aramid, glass, polyethylene, ceramic, and boron; yet even more preferably from the group consisting of carbon fiber, aramid, glass, polyethylene, and ceramic; yet even more preferably from the group consisting of carbon fiber, aramid, glass, and polyethylene; yet even more preferably from the group consisting of carbon fiber, aramid, and glass; yet even more preferably from the group consisting of carbon fiber and aramid; and most preferably comprises carbon fiber.

It has been found preferable, as can be surmised from the foregoing tables, that it is preferable for the lay-up of the shaft to include groups of parallel fibers oriented in different directions. Hence, for example the plurality of plies that form inner layer 410 include plies having uni-directional fibers oriented in a first direction and plies having uni-directional fibers oriented in a second direction that is different than the first.

The matrix or resin-based material in which the fibers are disposed may be selected from a group including: (1) thermoplastics such as polyether-ketone, polyphenylene sulfide, polyethylene, polypropylene, urethanes (thermoplastic), and Nylon-6, and (2) thermosets such as urethanes (thermosetting), epoxy, vinyl ester, polycyanate, and polyester. In the preferred construction set forth above thermoset resins have been satisfactorily employed.

In addition, it has been found preferable that the plies of fibers be pre-impregnated with a resin prior to being layered over one another and the mandrel. By so doing, it has been found that the lay-up of the plies is facilitated in that each ply is capable of acting as a tape and adhering to the preceding ply and hence may serve to facilitate the fixing of the relative position of the pre-cured plies to on another. In this regard, suitable materials include: (a) unidirectional carbon fiber tape pre-impregnated with epoxy, manufactured by Hexcel Corporation of Salt Lake City, Utah, and also S & P Systems of San Diego, Calif., (b) uni-directional glass fiber tape pre-impregnated with epoxy, also manufactured by Hexcel Corporation, (c) unidirectional Kevlar™ fiber tape pre-impregnated with epoxy, also manufactured by Hexcel Corporation, (d) 0/90 woven Kevlar™ fiber tape pre-impregnated with epoxy, also manufactured by Hexcel Corporation, and (e) 0/90 woven carbon tape pre-impregnated with epoxy, also manufactured by Hexcel corporation.

With respect to the middle elastomer layer, the term "elastomer" or "elastomeric", as used herein, is defined as, or refers to, a material having properties similar to those of vulcanized natural rubber, namely, the ability to be stretched to at least approximately twice its original length and to retract rapidly to approximately its original length when released. Hence, materials that fall within the definition of "elastomeric" as used and described herein include materials that have an ultimate elongation equal to or greater than 100% in accordance with the following formula:

$$\text{Ultimate Elongation Percentage}=\{[(\text{final length at rupture})-(\text{original length})]\div[\text{original length}]\}\times 100 \quad (1)$$

Where: Ultimate Elongation: also referred to as the breaking elongation, is the elongation at which specimen rupture occurs in the application of continued tensile stress as measured in accordance with ASTM Designation D 412 Standard Test Methods for Vulcanized Rubber and Thermoplastic Elastomers-Tension (August 1998).

Such elastomer materials may include: (1) vulcanized natural rubber; (2) synthetic thermosetting high polymers such as styrene-butadiene copolymer, polychloroprene(neoprene), nitrile rubber, butyl rubber, polysulfide rubber ("Thiokol"), cis-1,4-polyisoprene, ethylene-propylene terpolymers (EPDM rubber), silicone rubber, and polyurethane rubber, which can be cross-linked with sulfur, peroxides, or similar agents to control elasticity characteristics; and (3) Thermoplastic elastomers including polyolefins or TPO rubbers, polyester elastomers such as those marketed under the trade name "Hytrel" by E.I. Du Pont; ionomer resins such as those marketed under the trade name "Surlyn" by E.I. Du Pont, and cyclic monomer elastomers such as di-cyclo pentadiene (DCPD).

In addition, one criteria for assessing the appropriateness of an elastomer is its ability to be molded to the materials that form the inner and outer layers between which it is disposed. In the exemplary hockey shaft construction described above, it has been found that the following exemplary elastomer is capable of being employed successfully:

| | |
|---|---|
| Material: | Styrene Butadiene Rubber Latex |
| Supplier: | Diversified Materials Company, La Mesa, California |
| Hardness HS (JIS-A): | 65 +/− 5 |
| Elongation Percentage: | 200 or above |
| Tesnile Strength: | 100 Kgf/cm$^2$ or above |
| 180 Peel Value: | 10 kgf/25 mm or above |
| Weight: | 180 g/m$^2$ |

Notably, applicants have found that the employment of intermediate elastomer layer in a composite hockey stick shaft may impact or dampen the vibration typically produced from such shafts and thereby provides a means for controlling or tuning the vibration to produce or more desirable feel.

FIG. 16B is a flow chart detailing preferred steps for manufacturing the hockey stick shaft 20, prior to joining the shaft 20 to the blade 30 in accordance with the preferred manufacturing process described in FIG. 16A. In general a mandrel, dimensioned to have the desired internal dimensions of the tubular hollow 230 of the shaft 20, is provided (step 600). The mandrel is overlaid with a plurality of pre-impregnated plies of fibers which forms the inner layer 410 of the hockey stick shaft 20 (step 605). The inner layer 410 is then overlaid, at the desired location or locations, with a sheet of elastomer material, which forms the middle elastomer layer 420 of the hockey stick shaft 20 (step 610). The middle elastomer layer 420 is then overlaid with a plurality of pre-impregnated fiber plies, which form the outer layer 430 of the hockey stick shaft 20 (step 615). The un-cured shaft pre-form is then placed within a female mold and heat is applied to cure the shaft 20 over the mandrel. The mandrel is then removed from the cured shaft 20 (step 625).

The middle elastomer layer 420 may extend the full longitudinal length of the shaft 20 and/or on each of the four side walls (i.e. wide walls 150 and 160 and narrow walls 170 and 180) of the shaft 20 at any given cross-section of the shaft 20. It is contemplated, however, that the middle elastomer layer 420 may extend only along one or more discrete longitudinal portions of the shaft 20 and/or one or more discrete wall regions of the shaft 20.

Hence it is contemplated that the middle elastomer layer 410 may form any portion of a wall of the shaft 20 without necessary forming any other portion or wall of the shaft. Thus, for example, it is contemplated that middle elastomer layer 410 may, at any given cross-section of the shaft 20, form: (a) wide wall 150 and not wide wall 160 and/or narrow walls 170 and 180, (b) narrow wall 170 and not narrow wall 180 and/or wide walls 150 and 160, (c) narrow wall 170 and wide wall 150 but not narrow wall 180 nor wide wall 160, (d) narrow wall 170 and 180 but not wide walls 150 and 160, (e) wide walls 150 and 160 but not narrow walls 170 and 180, and (f) narrow wall 180 and wide wall 150 but not narrow wall 170 nor wide wall 160.

With respect to the longitudinal positioning of the middle elastomer layer reference is made to FIG. 21. Illustrated in FIG. 21 is a hockey stick 10 having a longitudinal length (L-HS), a shaft 20 having a longitudinal length (L-S), a first longitudinal length (L1) extending from the lower end of the shaft 20 or hockey stick 10 (i.e., including the blade 30), and a second longitudinal length (L2) extending upward from the termination of the first longitudinal length (L1) to the upper terminal end of the shaft 20. It is preferable that at least a portion of the middle elastomer layer 420 reside within longitudinal length L1; where L1=L-HS, even more preferably where L1=0.75×L-HS, even more preferably where L1=0.5×L-HS, even more preferably where L1=0.25×L-HS, yet even more preferably where L1 is 0.20×L-HS, yet even more preferably where L1 is 0.15×L-HS, yet even more preferably where L1 is 0.1×L-HS. Alternatively, it is preferable that at least a portion of the middle elastomer layer 420 reside within longitudinal length L1; where L1=L-S, even more preferably where L1=0.75×L-S, even more preferably where L1=0.5×L-S, even more preferably where L1=0.25×L-S, yet even more preferably where L1 is 0.20×L-S, yet even more preferably where L1 is 0.15×L-S, yet even more preferably where L1 is 0.1×L-S. Thus, for example if the longitudinal length of the hockey stick (L-HS) is 63 inches and the longitudinal length of the hockey stick shaft (L-S) is 60 inches long, then where L1=0.15×L-HS=9.45 inches or in other words it would be preferable that the elastomer layer, or at least a portion thereof, reside along the shaft within 9.45 inches of the tip of the blade 30. Where L1=0.15×L-S=9 inches or in other words it would be preferable that the elastomer layer, or at least a portion thereof, reside along the shaft within 9.0 inches of the terminal lower end 335 of the shaft 20. In the exemplary construction lay-up described, it has been found that the employment of an 8 inch elastomer sheet, formed of the above-identified exemplary elastomer, extending from the terminal lower end 335 of the shaft upwards and around each of the four sides or walls of the shaft 20 is capable of providing suitable results.

FIGS. 14 and 15 are cross-sectional views taken along line 14-14 and line 15-15 of FIG. 3 and illustrate in more detail the construction configurations of the hockey stick blade 30. It is to be understood that the configurations illustrated therein are exemplary and various aspects, such as core element 400 configurations or other internal structural configurations, illustrated or described in relation to the various constructions, may be combined or otherwise modified to facilitate particular design purposes or performance criteria. The construction of the blade 30 will now be described with reference to FIG. 16C, which is a flow chart detailing preferred steps for manufacturing the hockey stick blade 30. Generally, one or more plies of fibers 450, preferably uni-directional substantially parallel fibers pre-impregnated with a resin matrix as previously described, are wrapped over one or more core elements 400 having the general shape of the hockey stick blade 30 (step 630) to form an initial blade pre-form. The core elements 400 may be comprised or wholly formed of: (1)

formulations of expanding syntactic or non-syntactic foam such as polyurethane, PVC, or epoxy, (2) wood, (3) elastomer or rubber, and/or (4) bulk molding compound (i.e. non-continuous fibers disposed in a matrix or resin base material, which when cured become rigid solids). Thus, it is contemplated there be multiple core elements 400 of which some may be made of a first material, for example foam, while others may be made of second material, for example an elastomer or rubber.

Figure 17:
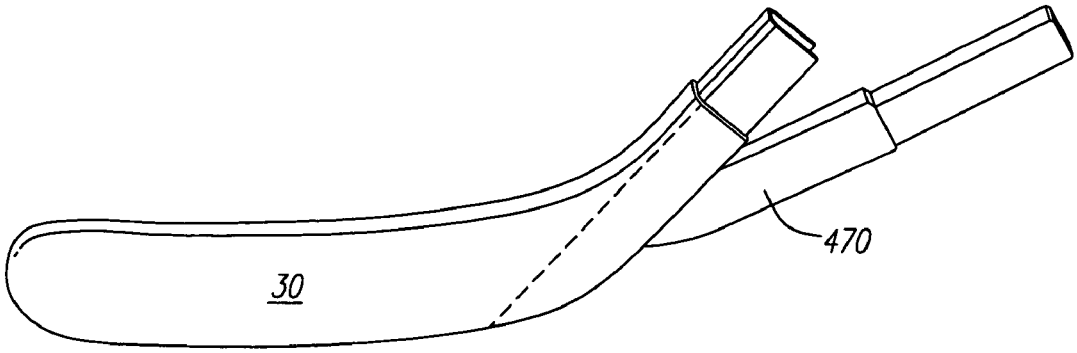
FIG. 17 is a diagram of the spacer element being removed from the pre-cured hockey stick blade illustrated in FIG. 3.

After the initial blade pre-form is formed a spacer element 470 is butted up against the rear of the initial blade pre-form such that the spacer element is positioned to occupy the heel region of the blade and additional plies of fibers overlain to form a secondary blade pre-form (Step 635). The spacer element 470 is dimensioned to generally correspond to the outer dimensions of the lower regions of the shaft 20 configured to mate with the blade. The spacer element 470 is then removed from the secondary blade pre-form (step 640). FIG. 17 is a diagram that illustrates the spacer element 470 being removed from the pre-cured hockey stick blade pre-form.

Figure 18:
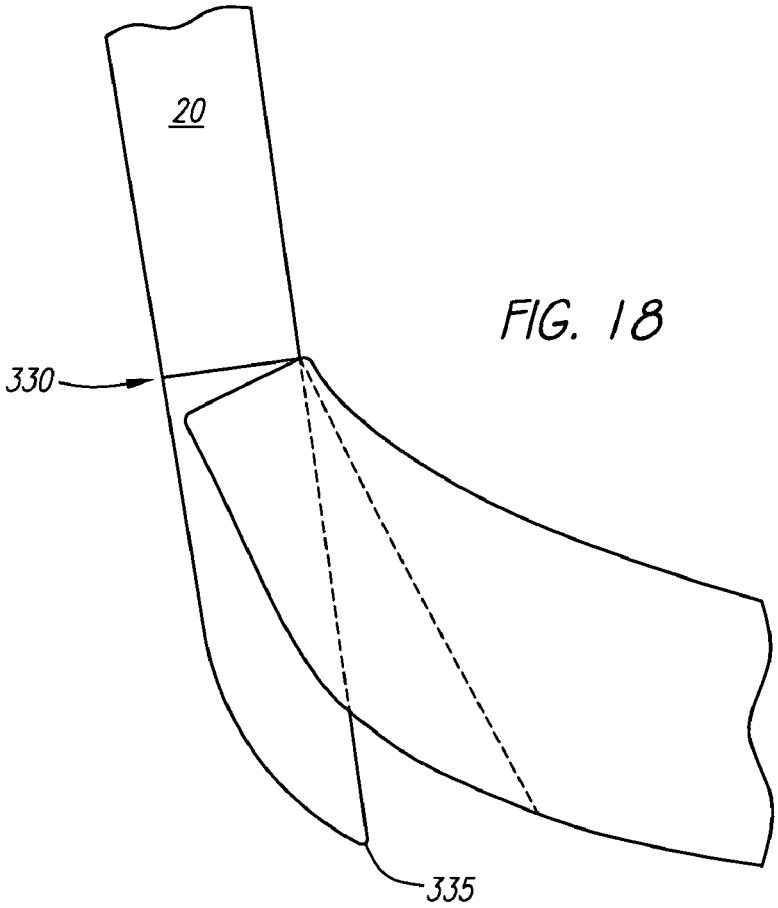
FIG. 18 is a diagram of the cured hockey stick shaft being inserted into the pre-cured hockey stick blade illustrated in FIG. 3.

FIG. 16A is a flow chart detailing preferred steps for constructing a unitary hockey stick by joining the cured hockey stick shaft (step 645) described above with the un-cured secondary hockey stick blade pre-form (step 650). Generally once the spacer element 470 is removed the cured hockey stick shaft 20 is inserted into the space at the heel section 140 previously occupied by the spacer element 470 between the front and back walls 90 and 100 of the pre-cured hockey stick blade pre-form as illustrated in FIG. 18 (step 655). Additional plies of fibers may be overlain about the blade and around the heel and lower end region of the shaft to cover any gaps around the edges or to reinforce any week regions around for example the heel region. The cured shaft and the un-cured blade pre-form are inserted into the a female mold configured to (a) received the uncured blade pre-form and at least a portion of the lower region of the cured shaft and (b) having the desired exterior shape of the hockey stick blade (step 660). FIG. 19 is diagrams illustrating the un-cured hockey stick blade and the cure hockey stick shaft assembled in the open mold prior to molding and FIG. 20 is an illustration of the hockey stick blade and cured hockey stick shaft assembled in the closed mold prior to curing. Once the mold is closed heat is applied and the blade is cured around the interposed lower region of the shaft (step 670) to form a unitary one-piece composite hockey stick having a hollow tubular shaft that extends internally within the front and back walls of the blade. The hockey stick is then removed from the mold and finished for example via painting or decaling or perhaps sanding or grinding any imperfections out from the molded finish.

While there has been illustrated and described what are presently considered to be preferred embodiments and features of the present invention, it will be understood by those skilled in the art that various changes and modifications may be made, and equivalents may be substituted for elements thereof, without departing from the scope of the invention. For example, it is contemplated that the composite hockey stick shaft having a middle elastomer layer 420 disclosed and taught herein be employed in hockey stick shaft configurations disclosed and taught in co-pending and owned U.S. patent Ser. No. 10/439,652 filed on May 15, 2003. In addition, it is contemplated, for example, that the composite hockey stick shaft having a middle elastomer layer 420 disclosed and taught herein be employed in hockey sticks having the composite blade structures disclosed and taught in co-pending and owned U.S. patent Ser. No. 10/439,652 filed on May 15, 2003.

In addition, many modifications may be made to adapt a particular element, feature or implementation to the teachings of the present invention without departing from the central scope of the invention. Therefore, it is intended that this invention not be limited to the particular embodiments disclosed herein, but that the invention include all embodiments falling within the scope of the appended claims. In addition, it is to be understood that various aspects of the teachings and principles disclosed herein relate configuration of the blades and hockey sticks and component elements thereof. Other aspects of the teachings and principles disclosed herein relate to internal constructions of the component elements and the materials employed in their construction. Yet other aspects of the teachings and principles disclosed herein relate to the combination of configuration, internal construction and materials employed therefor. The combination of one, more than one, or the totality of these aspects defines the scope of the invention disclosed herein. No other limitations are placed on the scope of the invention set forth in this disclosure. Accordingly, the invention or inventions disclosed herein are only limited by the scope of this disclosure that supports or otherwise provides a basis, either inherently or expressly, for patentability over the prior art. Thus, it is contemplated that various component elements, teachings and principles disclosed herein provide multiple independent basis for patentability. Hence no restriction should be placed on any patentable elements, teachings, or principles disclosed herein or combinations thereof, other than those that exist in the prior art or can under applicable law be combined from the teachings in the prior art to defeat patentability.

What is claimed is:

1. A hockey stick comprising:

(a) a composite hockey stick shaft that extends from a terminal top end to a terminal lower end, said hockey stick shaft includes an inner composite construct, an outer composite construct, an elastomer layer disposed between the inner composite construct and the outer composite construct, each of said inner and outer composite constructs comprising one or more plies of substantially parallel fibers disposed in a hardened resin matrix; and (b) a cure molded composite blade extending from a tip region to a heel region comprising a multi-component core construct including one or more elastomer core components completely encased within one or more plies of fibers disposed in a hardened resin matrix and one or more non-elastomer core components encased within one or ore more plies of fibers disposed within a hardened resin matrix, wherein said shaft is cure molded to said blade within an open-ended slot disposed at the heel of the blade.

2. The hockey stick of claim 1, wherein the inner composite construct is comprised of a generally rectangular hollow tubular structure.

3. The hockey stick of claim 1, wherein the outer composite construct is comprised of a generally rectangular hollow tubular structure.

4. The hockey stick of claim 1, wherein the inner composite construct has a greater cross-sectional thickness dimension than the outer composite construct.

5. The hockey stick of claim 1 wherein said elastomer layer is constructed of a material that has an ultimate elongation that is approximately equal to or greater than 100%, such that it can be stretched to at least approximately double its length at rest without rupture, and when released, returns quickly to approximately its pre-stretched length.

6. The hockey stick of claim 1 wherein said elastomer layer has a thickness of loss than ⅙ inch.

7. The hockey stick of claim 1 wherein the periphery of said inner composite construct is only partially encircled by said elastomer layer.

8. The hockey stick of claim 7 wherein said elastomer layer encircles less than 50% of the periphery of said inner composite construct.

9. The hockey stick of claim 1 wherein said elastomer layer overlies less than the entire longitudinal length of said inner composite construct.

10. A hockey stick comprising:

(a) a composite hockey stick shaft that extends from a terminal top end to a terminal lower end, said hockey stick shalt includes an inner composite construct, an outer composite construct, an elastomer layer disposed between the inner composite construct and the outer composite construct, each of said inner and outer composite construct comprising one or more plies of unidirectional substantially parallel fibers disposed in a hardened resin matrix; and (b) a cure molded composite blade extending from a tip region to a heel region comprising a multi-component core construct including one or more elastomer core components completely encased within one or more plies of fibers disposed in a hardened resin matrix and one or more non-elastomer core components encased by one or more plies of fibers disposed within a hardened resin matrix, wherein said terminal lower end of the composite hockey stick shaft is cure-moldedly lowered with the composite blade at said heel region.

11. The hockey stick of claim 10, wherein the inner composite construct is comprised of a generally rectangular hollow tubular structure.

12. The hockey stick of claim 10, wherein the outer composite construct is comprised of a generally rectangular hollow tubular structure.

13. The hockey stick of claim 10, wherein the inner composite construct has a greater cross-sectional thickness dimension than the outer composite construct.

14. The hockey stick of claim 10 wherein said elastomer layer is constructed of a material that has an ultimate elongation that is approximately equal to or greater than 100%, such that it can be stretched to at least approximately double its length at rest without rupture, and when released, returns quickly to approximately its pre-stretched length.

15. The hockey stick of claim 10 wherein said elastomer layer has a thickness of less than 1/16 inch.

16. The hockey stick of claim 10 wherein the periphery of said inner composite construct is only partially encircled by said elastomer layer.

17. The hockey stick of claim 16 wherein said elastomer layer encircles less than 50% of the periphery of said inner composite construct.

18. The hockey stick of claim 10 wherein said elastomer layer overlies less than the entire longitudinal length of said inner composite construct.

* * * * *